US006565489B2

(12) United States Patent
Ho et al.

(10) Patent No.: US 6,565,489 B2
(45) Date of Patent: May 20, 2003

(54) ANGLED-ADJUSTABLE ROWING EXERCISER

(76) Inventors: Sung-Cho Ho, 10th Floor, No. 360, Section 1, Fu-Shing South Road, Taipei (TW); Michael E. Casey, 201 Ocean Ave., #406-P, Santa Monica, CA (US) 90402

( * ) Notice: Subject to any disclaimer, the term of this patent is extended or adjusted under 35 U.S.C. 154(b) by 0 days.

(21) Appl. No.: 09/956,378

(22) Filed: Sep. 18, 2001

(65) Prior Publication Data

US 2002/0055423 A1 May 9, 2002

Related U.S. Application Data

(63) Continuation-in-part of application No. 09/809,851, filed on Mar. 15, 2001, which is a continuation of application No. 09/396,510, filed on Sep. 15, 1999, now Pat. No. 6,206,808.

(51) Int. Cl.[7] ..... A63B 21/068

(52) U.S. Cl. ..... 482/95; 482/70

(58) Field of Search ..... 482/71, 95, 72, 482/96, 135, 126, 140–142

(56) References Cited

U.S. PATENT DOCUMENTS

| | | | | |
|---|---|---|---|---|
| 3,342,485 | A | 9/1967 | Gaul | 272/58 |
| 5,106,078 | A | 4/1992 | Rowe | 482/138 |
| 5,277,684 | A | 1/1994 | Harris | 482/130 |
| 5,795,271 | A | 8/1998 | Pearson | 482/72 |
| 5,839,998 | A | 11/1998 | Wilkinson | 482/140 |
| 5,967,950 | A | 10/1999 | Hsu | 482/96 |
| 5,997,450 | A | 12/1999 | Wilkinson | 482/142 |
| 6,123,653 | A | 9/2000 | Huang | 482/142 |

*Primary Examiner*—Michael A. Brown
*Assistant Examiner*—Lori Baker Amerson
(74) *Attorney, Agent, or Firm*—Cislo & Thomas LLP

(57) ABSTRACT

An angle-adjustable rowing exerciser, which includes a wheeled base frame, a fixed mattress and a pivoted mattress supported on the base frame, a transverse frame bar pivotally mounted on the base frame at the bottom, two handlebars respectively adjustably connected to two adjustable ratchet connectors at the ends of the transverse frame bar for turning by hand to rotate the transverse frame bar, and two actuating bars perpendicularly and fixedly connected to the transverse frame bar and forced to tilt the base frame or the movable mattress up and down upon turning of the handlebars.

20 Claims, 9 Drawing Sheets

ANGLED-ADJUSTABLE ROWING EXERCISER

Cross-References to Related Applications

This patent application is a continuation-in-part Application of U.S. Pat. application Ser. No. 09/809,851 filed Mar. 15, 2001 for ANGLE-ADJUSTABLE ROWING EXERCISER, which is a continuation of U.S. patent application Ser. No. 09/396,510 filed Sep. 15, 1999 which issued as U.S. Pat. No. 6,206,808 on Mar. 27, 2001, which applications are incorporated herein by this reference thereto.

BACKGROUND OF THE INVENTION

1. Field of the Invention

The present invention relates to a rowing exerciser, and more particularly to an angle-adjustable rowing exerciser, which can be conveniently adjusted to the desired angle of inclination.

2. Description of the Related Art

A variety of exercising apparatus have been disclosed for different exercising purposes, and have appeared on the market. Regular multipurpose exercising apparatus are commonly heavy and expensive, and not suitable for home use. Regular simple climbers, rowers, stationary bicycles are less expensive, and suitable for one use. However, these exercising apparatus arc designed for one particular exercising purpose only.

SUMMARY OF THE INVENTION

The present invention has been accomplished under the circumstances in view. According to one aspect of the present invention, the angle-adjustable rowing exerciser comprises a wheeled base frame, a fixed mattress and a pivoted mattress supported on the base frame, a transverse frame bar pivotally mounted on the base frame at the bottom, two handlebars respectively connected to the ends of the transverse frame bar for turning by hand to rotate the transverse frame bar, and two actuating bars perpendicularly and fixedly connected to the transverse frame bar and forced to tilt the base frame or the movable mattress up and down upon turning of the handlebars. According to another aspect of the present invention, the transverse frame bar comprises two adjustable ratchet connectors at its two distal ends respectively connected to the handlebars, enabling the handlebars to be adjusted to one of a series of angular positions relative to the transverse frame bar.

OBJECTS OF THE INVENTION

It is one object of the present invention to provide an angle-adjustable rowing exerciser, which is practical for exercising different parts of the body.

It is another object of the present invention to provide an angle-adjustable rowing exerciser, which is inexpensive to manufacture, and suitable for home use.

It is still another object of the present invention to provide an angle-adjustable rowing exercising, which can be conveniently adjusted to fit different exercising requirements.

It is yet another object of the present invention to provide a reverse abdominal exercise.

It is yet another object of the present invention to provide a movable bar to limit the movement of the reverse abdominal exercise in order to limit the difficulty of the exercise.

It is yet another object of the present invention to provide adjustable handlebars to allow for adjustments in the difficulty of the exercise.

It is yet another object of the present invention to provide head and neck supports for use during the exercise.

It is yet another object of the present invention to provide wheels on the base of the product for easier transportation.

These and other objects and advantages of the present invention will be apparent from a review of the following specification and accompanying drawings.

DESCRIPTION OF THE PREFERRED EMBODIMENT(S)

The detailed description set forth below in connection with the appended drawings is intended as a description of presently-preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

Figure 14:
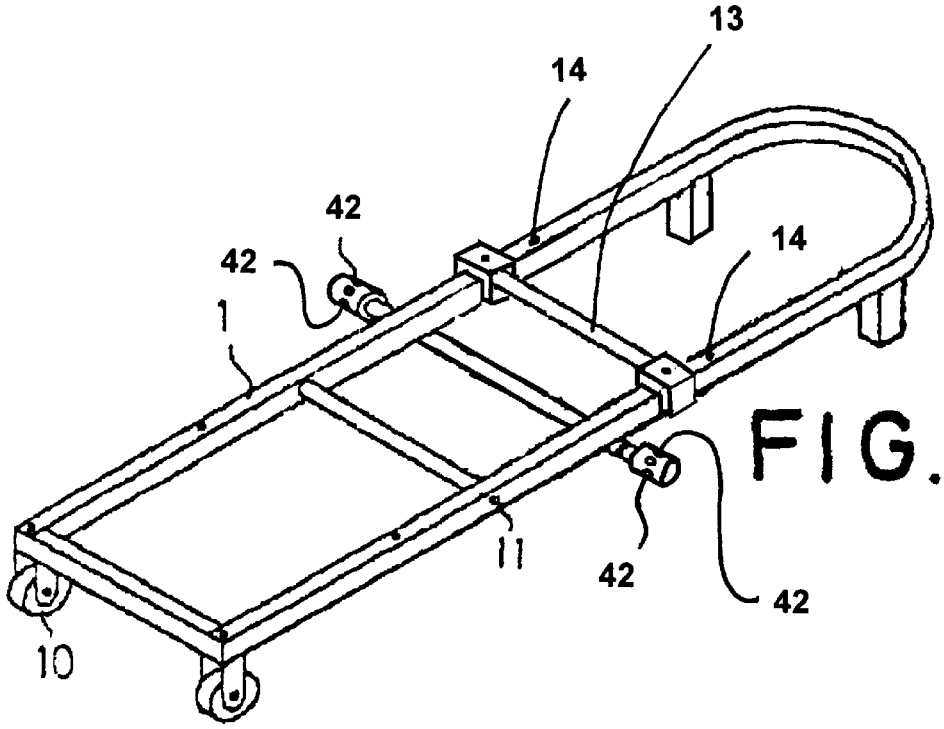
FIG. 14 is a perspective view of the present invention after removal of the mattress and the actuating member.
Figure 15:
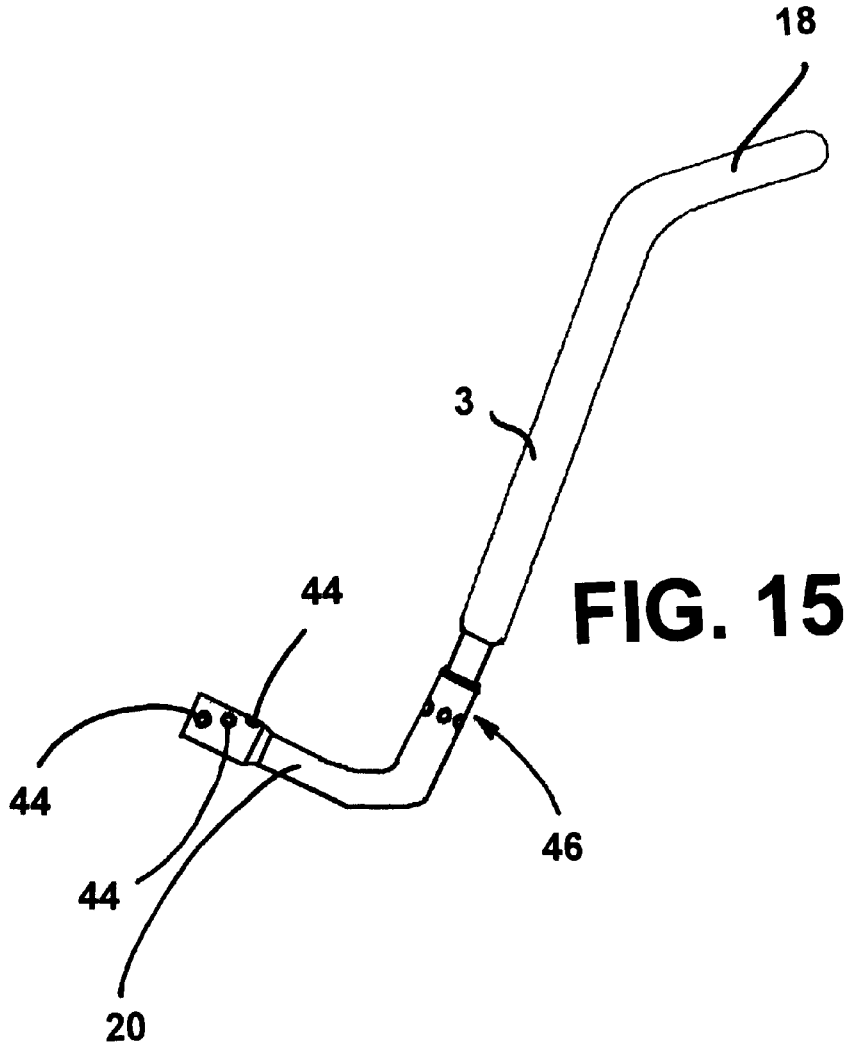
FIG. 15 is a front view of an example of a handlebar of the present invention.

Referring to FIGS. from 1 through 4, an angle-adjustable rowing machine is shown comprised of an elongated base frame 1 or support structure, a first mattress 2, a pair of handlebars 3, a transverse frame bar 4, a second mattress 5, and a pair of actuating bars 6. The base frame 1 can be equipped with rollers 10 for easy moving on the floor. The first mattress 2 is fixedly mounted on the base frame 1 at one end. The second mattress 5 has one end pivoted to a middle part of the base frame 1 by a pivot 11. When in a down position, the second mattress 5 is supported on the base frame 1 and aligned with the first mattress 2 in a line. The transverse frame bar 4 is pivotally mounted on the base frame 1 below the second mattress 5, having two ratchet connectors 40 at two distal ends thereof Different embodiments of the transverse frame bar 4 can be used with the present invention. One embodiment, shown in FIG. 14, shows the transverse frame bar 4 having a plurality of openings 42 disposed at the two distal ends thereof The type of handlebar 3 used in this embodiment is shown in FIG. 15. A plurality of openings 44 located on the lower end 20 of the handlebar 3 align with the plurality of openings 42 disposed at the distal ends of the transverse frame bar 4 so that the handlebars 3 can be placed in a series of angular positions relative to the transverse frame bar 4. The upper end 18 of the handlebars 3 also can include adjustment means 42 allowing the upper end 18 to be orientated in different positions relative to the lower end 20.

The handlebars 3 are respectively connected to the ratchet connectors 40. or to the plurality of openings 42, and adjusted to the desired angle relative to the transverse frame bar 4. One or more handlebars 3 can be used with regards to the present invention. Other designs for handlebars 3 can also be used such as one that provides a single bar. One or more actuating bars 6 are perpendicularly and fixedly connected to the transverse frame bar 4, each having a distal end mounted with a roller 60. The base frame 1 may set one or more pairs of aligned holes 12, 14 at the side of the second mattress 5 (see FIGS. 11, 12 and 14). The holes 12 can insert a bar 13 to confine the inclined angle of the actuating bars 6. The bar 13 may either be inserted into holes 12, 14 or may be removed allowing the full range of motion of the actuating bars 6.

Figure 2:
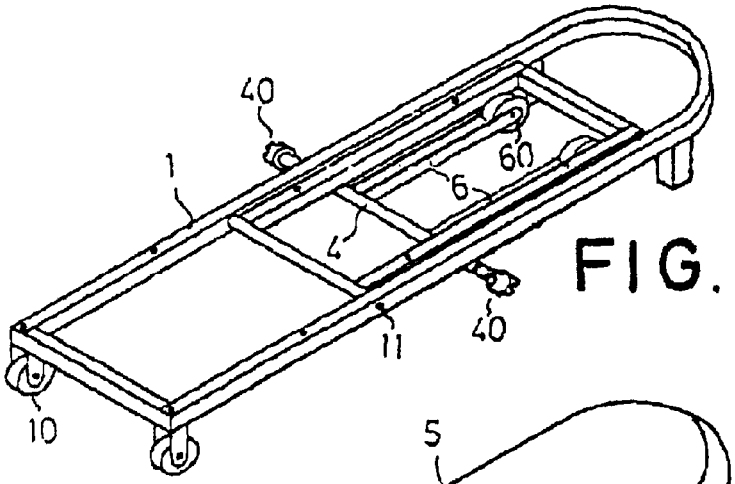
FIG. 2 is a perspective view of the present invention after removal of the first mattress, the second mattress, and the handlebars.
Figure 1:
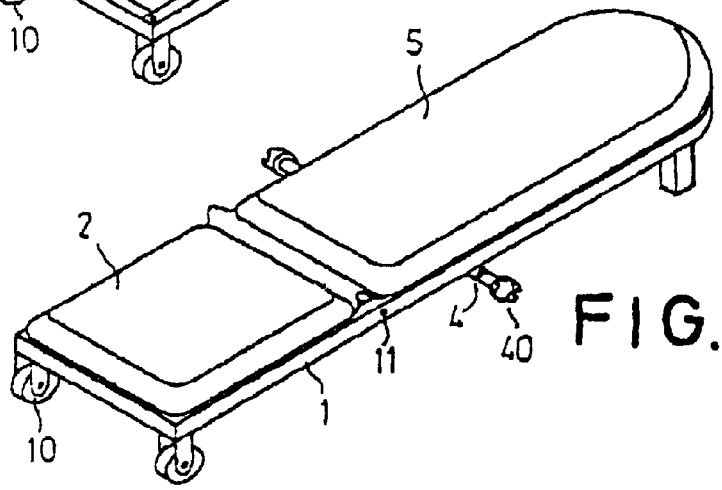
FIG. 1 is a perspective view of an angle-adjustable rowing exerciser according to the present invention (the handlebars excluded)
Figure 4:
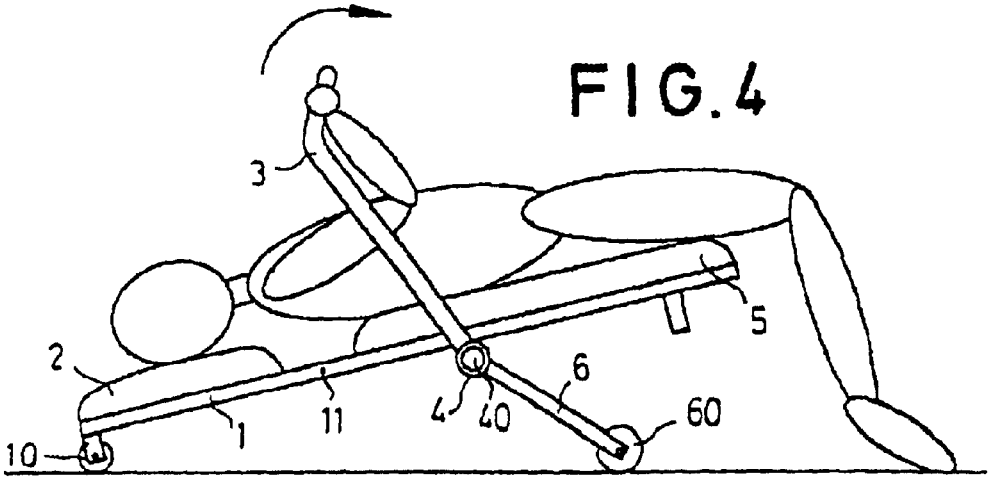
FIG. 4 shows a first application example of the present invention.
Figure 3:
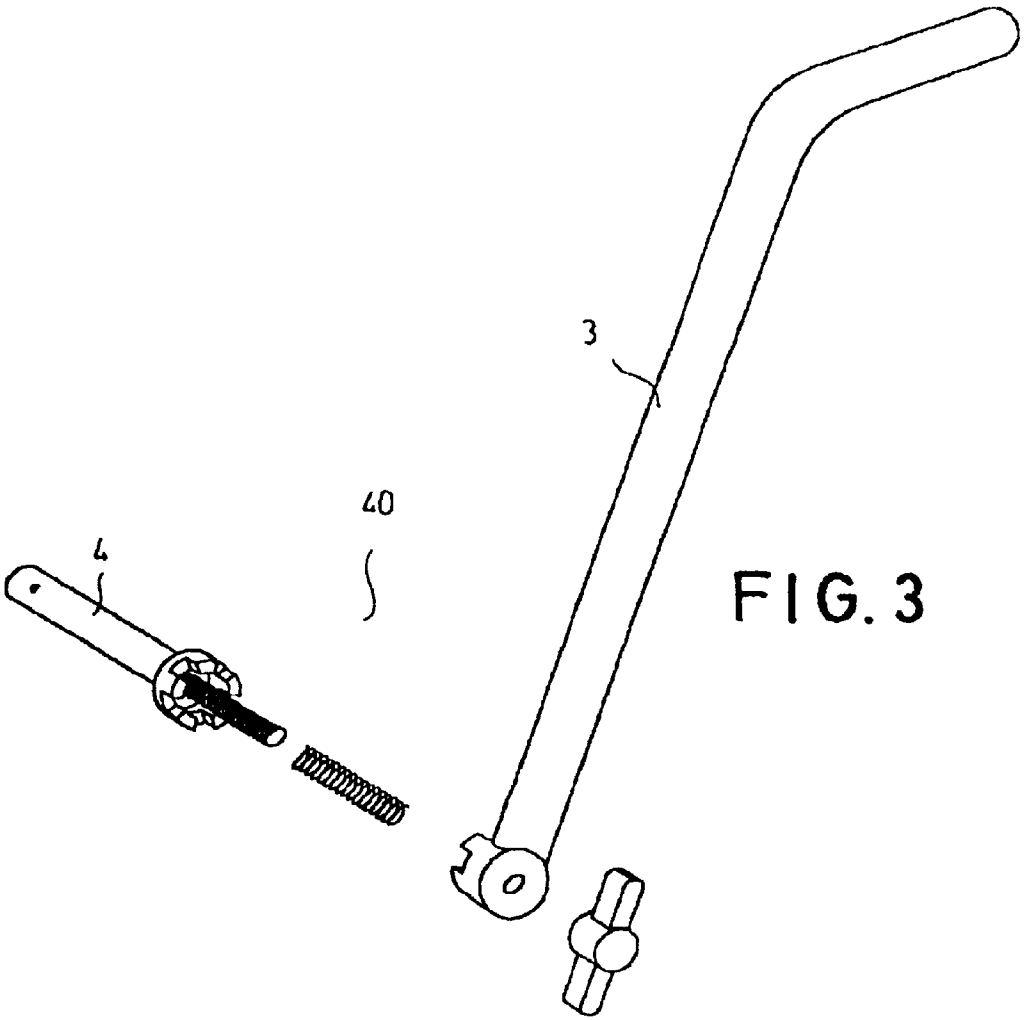
FIG. 3 is an exploded view of a part of the present invention , showing the structure of a ratchet connector.
Figure 5:
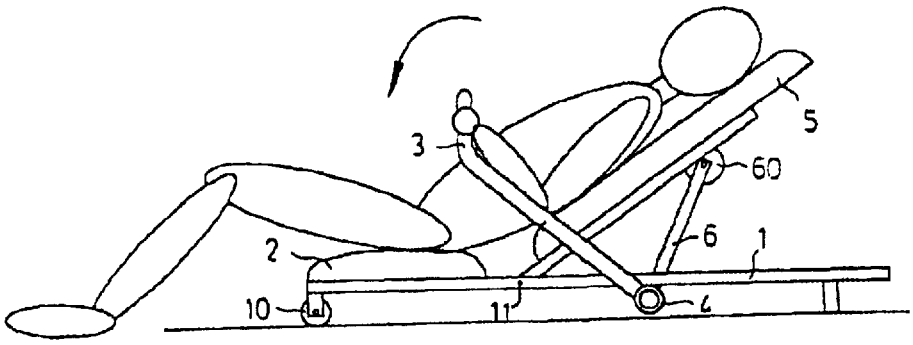
FIG. 5 shows a second application example of the present invention.
Figure 6:
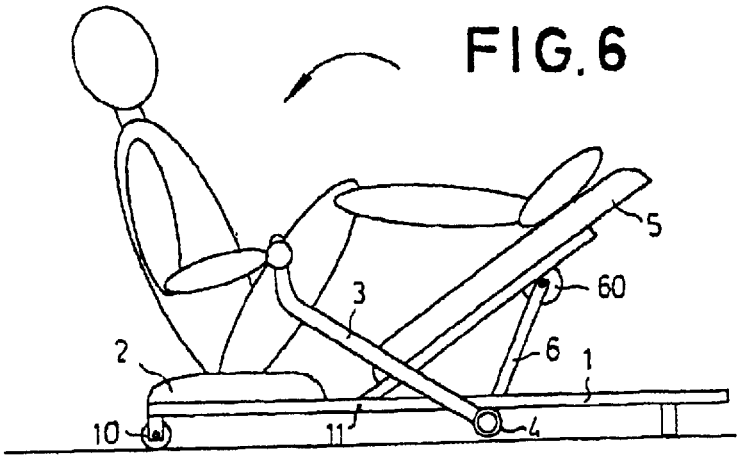
FIG. 6 shows a third application example of the present invention.
Figure 7:
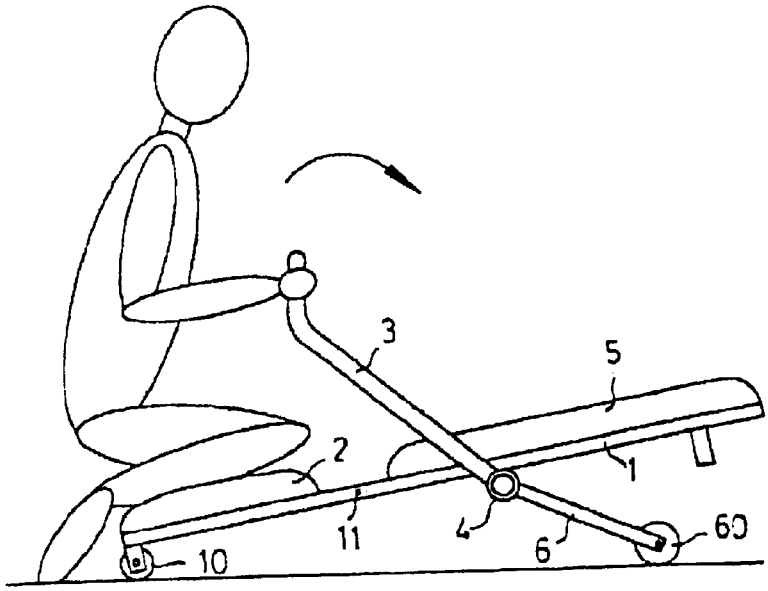
FIG. 7 shows a fourth application example of the present invention.
Figure 8:
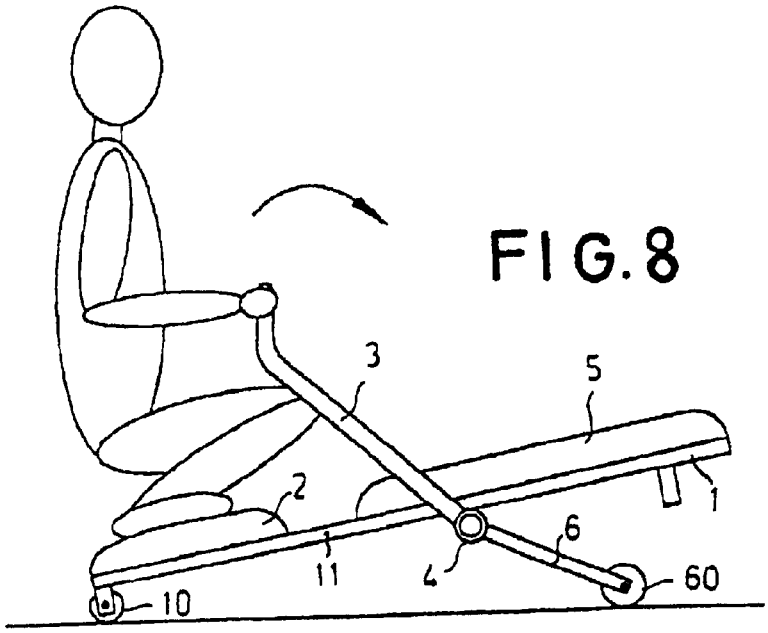
FIG. 8 shows a fifth application example of the present invention.
Figure 9:
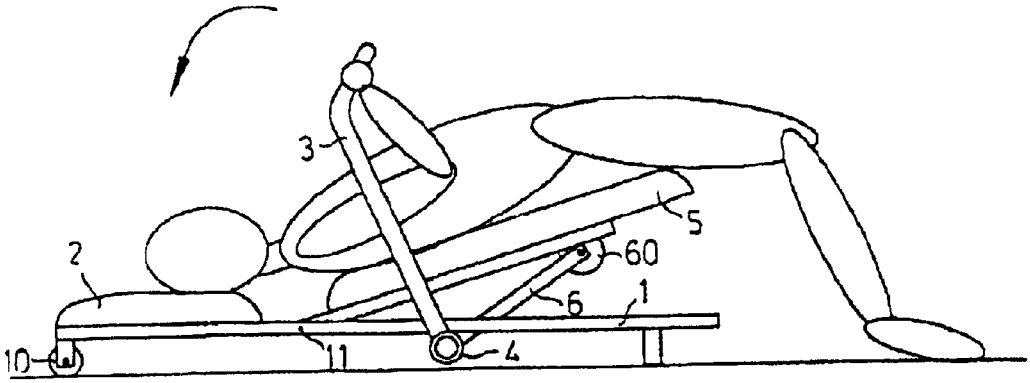
FIG. 9 shows a sixth application example of the present invention
Figure 10:
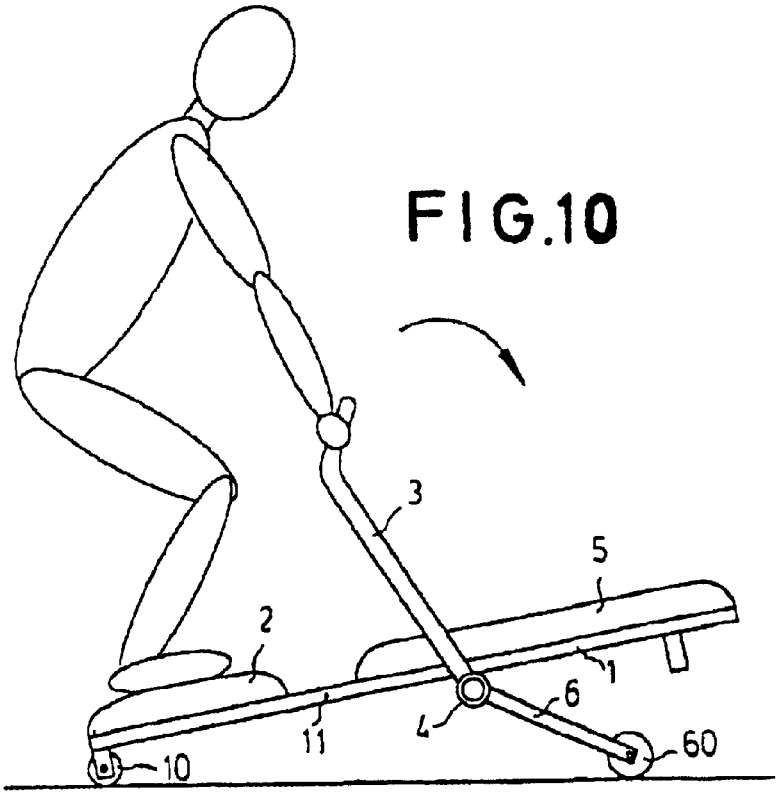
FIG. 10 shows a seventh application example of the present invention.
Figure 11:
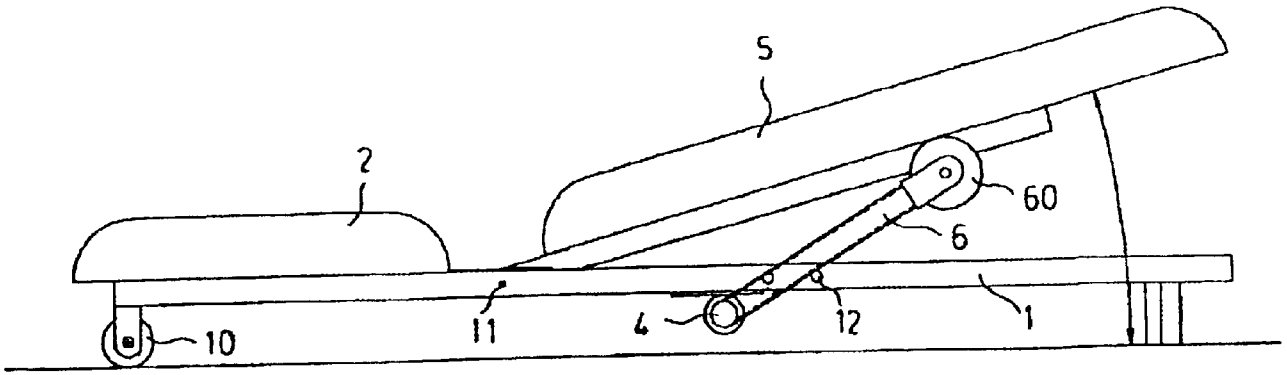
FIG. 11 is a schematic side view of an another base frame of the present invention in one way.
Figure 12:
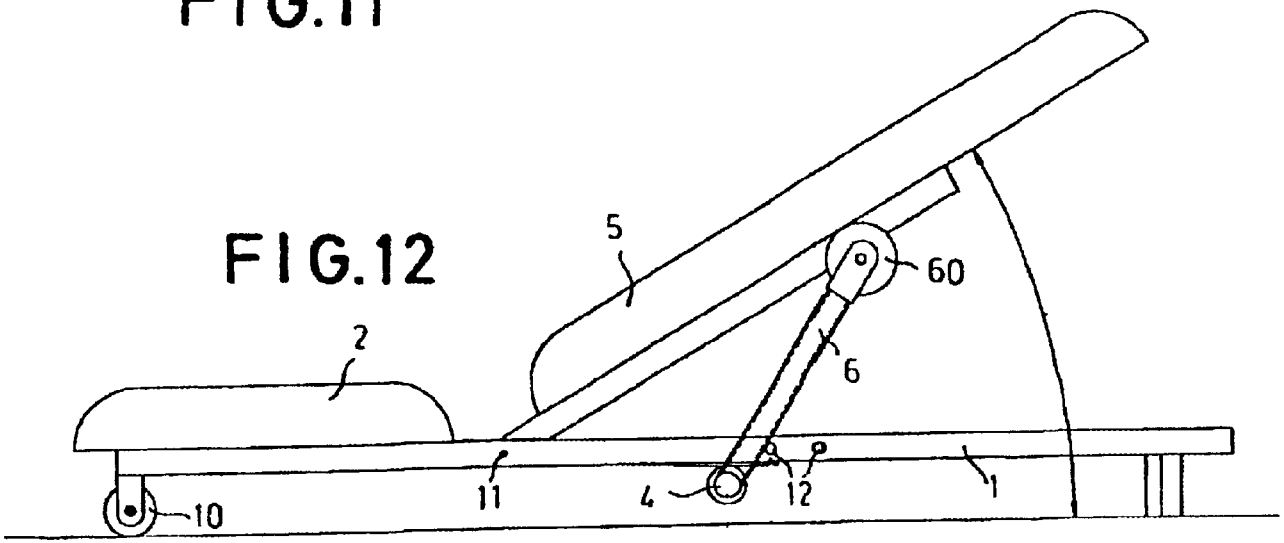
FIG. 12 is a schematic side view of the present invention in FIG. 11 in another way.

Referring to FIGS. from 5 through 10 and FIG. 4 again, the angle-adjustable rowing exerciser can be operated in any of a variety of operation modes. For example, the user can lie on the mattresses 2 and 5, sit, kneel or stand on the first mattress 2, or sit on the heels above the first mattress 2, and turn the handlebars 3 back and forth when keeping the rollers 60 of the actuating 5 bars 6 stopped at the floor (see FIGS. 4, 7, 8 and 10) or the bottom of the second mattress 5 (5 cC FIGS. 5, 6 and 9). When turning the handlebars 3 back and forth, the second mattress 5 or the base frame 1 is tilted up and down. By means of adjusting the angular position of the handlebars 3 relative to the transverse frame bar 4, the exercising amount is relatively adjusted. Referring to FIGS. 11, 12 and 14, a bar 13 or similar object can be inserted into the holes 12 in order to confine the actuating bars 6. The result being that the second mattress 5 can be limited in the angle that it will decline and thus reducing the difficulty of the exercise. Additional holes 14 are available for placement of the bar 13 in order to increase or reduce the angle that the second mattress 5 will decline, thus increasing or reducing the range of motion of the actuating bars 6, thereby increasing or reducing the difficulty of the exercise.

Figure 13:
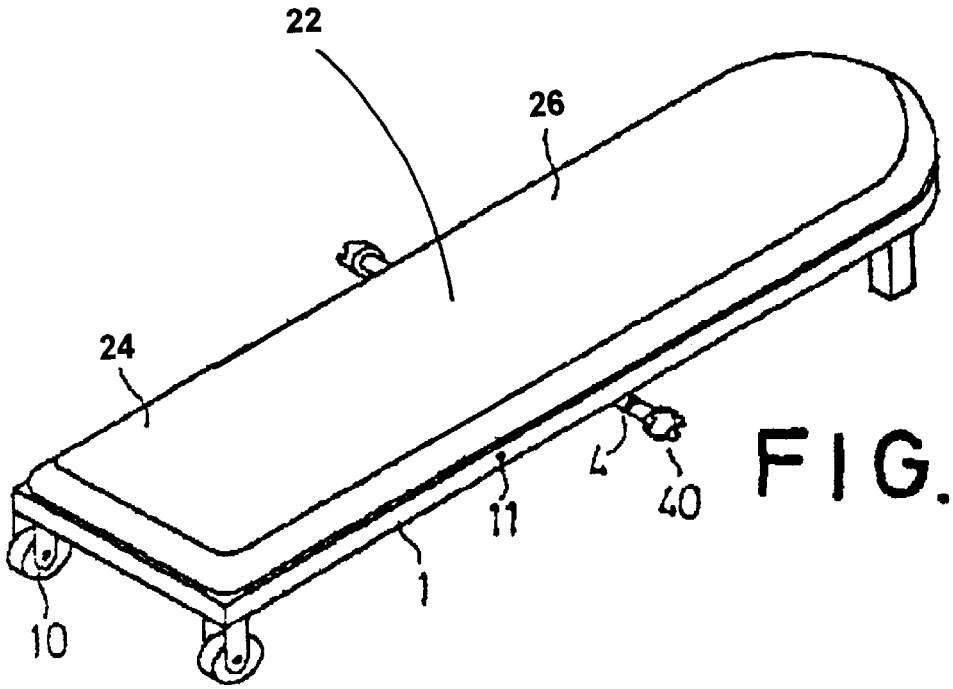
FIG. 13 is a perspective view of an embodiment of the present invention showing a uniform mattress.

Another embodiment of the mattress 22 of the present invention is shown in FIG. 13. Here, a mattress 22 having a front portion 24 and a rear portion 26 is shown. The front portion 24 can be fixedly mounted on the base frame 1 and the rear portion 26 can have one end pivoted to a middle part of the base frame 1 adjacent to the front portion 24 of the mattress 22 by a pivot. The front portion 24 and rear portion 24 can be used to support a user on the base frame 1. In 20 this embodiment, the transverse frame bar 4 is located below the rear portion 26 of the mattress 22.

It is to be understood that the drawings are designed for purposes of illustration only, and are not intended for use as a definition of the limits and scope of the invention disclosed.

While the present invention has been described with regards to particular embodiments, it is recognized that additional variations of the present invention may be devised without departing from the inventive concept.

What is claimed is:

1. An angle-adjustable rowing exerciser, comprising:

a base frame having rollers;

a first mattress fixedly mounted on said base frame at one end;

a second mattress for supporting the user on said base frame, said second mattress having one end pivoted to a middle part of said base frame adjacent to said first mattress by a pivot;

a transverse frame bar transversely pivoted to said base frame below said second mattress, said transverse frame bar having two distal ends extended out of two opposite lateral sides of said base frame;

one or more handlebars having an upper end and a lower end, said lower end connected to said two distal ends of said transverse frame bar for turning by hand to rotate said transverse frame bar; and one or more actuating bars perpendicularly and fixedly connected to said transverse frame bar, said one or more actuating bars having a distal end mounted with a roller;

whereby a predetermined abdominal exercise can be performed.

2. An angle-adjustable rowing exerciser as set forth in claim 1, wherein said transverse frame bar includes a plurality of openings disposed at said two distal ends thereof and aligns with a plurality of openings of said one or more handlebars to connect said one or more handlebars in one of a series of angular positions relative to said transverse frame bar.

3. An angle-adjustable rowing exerciser as set forth in claim 2, wherein said base frame including one or more pairs of aligned holes below said second mattress, a bar inserted into said holes confines the inclined angle of said one or more actuating bars.

4. An angle-adjustable rowing exerciser as set forth in claim 3, wherein said upper end of said handle bars having adjustment means, said adjustment means allowing for said upper end of said handlebars to be oriented in a plurality of positions.

5. An angle-adjustable rowing exerciser comprising:

a base frame having rollers;

a mattress, having a front portion and a rear portion, said front portion of said mattress fixedly mounted on said base frame at one end, said rear portion of said mattress for supporting the user on said base frame, said rear portion of said mattress having one end pivoted to a middle part of said base frame adjacent to said front portion of said mattress by a pivot;

a transverse frame bar transversely pivoted to said base frame below said rear portion of said mattress, said transverse frame bar having two distal ends extended out of two opposite lateral sides of said base frame;

one or more handlebars having an upper end and a lower end connected to the two distal ends of said transverse frame bar for turning by hand to rotate said transverse frame bar; and one or more actuating bars perpendicularly and fixedly connected to said transverse frame bar;

whereby a predetermined abdominal exercise can be performed.

6. An angle-adjustable rowing exerciser as set forth in claim 5, wherein said one or more actuating bars having a distal end mounted with a roller;

said transverse frame bar includes two adjustable connectors respectively disposed at said two distal ends thereof and connected to said one or more handlebars to hold said one or more handlebars in one of a series of angular positions relative to said transverse frame bar.

7. An angle-adjustable rowing exerciser as set forth in claim 6, wherein a said base frame includes one or more pairs of aligned holes below said rear portion of said mattress, a bar inserted into said holes confines the inclined angle of said one or more actuating bars.

8. An angle-adjustable rowing exerciser as set forth in claim 7, wherein said upper end of said one or more handle bars having adjustment means, said adjustment means allowing for said one or more handlebars to be oriented in a plurality of positions.

9. An angle-adjustable rowing exerciser, comprising:

a base frame;

means for supporting a lower body portion, said lower body supporting means coupled to said base frame;

means for supporting an upper body portion, said upper body supporting means having one end pivoted to a middle part of said base frame adjacent to said lower body supporting means by a pivot;

actuating means for pivoting said upper body supporting means, said actuating means coupled to said base frame;

to whereby abdominal muscles are exercised when said actuating means pivots said upper body supporting means during a predetermined abdominal exercise.

10. An angle-adjustable rowing exerciser as set forth in claim 9, further comprising means for engaging hands, said hands engaging means coupled to said actuating means.

11. An angle-adjustable rowing exerciser, comprising:

a base frame;

means for supporting an upper body portion, said upper body supporting means coupled to said base frame;

means for supporting a lower body portion, said lower body supporting means having one end pivoted to a middle part of said base frame adjacent to said upper body supporting means by a pivot;

means for engaging hands;

actuating means for pivoting said lower body supporting means, said actuating means coupled to said base frame and said hands engaging means;

whereby abdominal muscles are exercised when said actuating means pivots said lower body supporting means during a predetermined abdominal exercise.

12. An exerciser, comprising a support structure adaptable for association to the ground;

a pivoting member having one end pivoted to said support structure;

a support surface having a first end and a second end, said first end of said support surface coupled to said support structure, said second end of sad support surface coupled to said pivoting member;

an actuating bar, said actuating bar pivotally coupled to said support structure;

whereby the movement of said actuating bar causes movement of said pivoting member and allows for a predetermined abdominal exercise.

13. An exerciser as set forth in claim 12, further comprising one or more handlebars having upper and lower ends, said lower ends of said handlebars coupled. to said actuating bar such that movement of said handlebars causes movement of the actuating bar.

14. An exerciser as set forth in claim 13, wherein said support structure including rollers for association to the ground;

said actuating bar having a distal end including a roller.

15. An exerciser as set forth in claim 14, wherein said upper end of said one or more handle bars having adjustment means, said adjustment means allowing for said one or more handlebars to be oriented in a plurality of positions.

16. An exerciser as set forth in claim 15, wherein said support structure includes one or more pairs of aligned holes below said second end of said support surface, a bar inserted into said holes confines the inclined angle of said actuating bar.

17. An exerciser comprising a base frame;

a first mattress fixedly mounted on said base frame at one end;

a second mattress for supporting the user on said base frame, said second mattress having one end pivoted to a middle part of said base frame adjacent to said first mattress by a pivot, a frame bar pivoted to said base frame below said second mattress, said frame bar having two distal ends, one or more handlebars having an upper end and a lower end, said lower end connected to said two distal ends of said frame bar for turning by hand to rotate said frame bar; and one or more actuating bars coupled to said frame bar, said one or more actuating bars having an end mounted with a roller;

whereby a predetermined abdominal exercise can be performed.

18. An exerciser as set forth in claim 17, wherein said frame bar includes a plurality of openings disposed at said two distal ends thereof and aligns with a plurality of openings of said one or more handlebars to connect said one or more handlebars in one of a series of angular positions relative to said transverse frame bar.

19. An exerciser as set forth in claim 18, wherein said base frame including one or more pairs of aligned holes below said second mattress, a bar inserted into said holes confines the inclined angle of said one or more actuating bars.

20. An exerciser as set forth in claim 19, wherein said upper end of said handle bars having adjustment means, said adjustment means allowing for said upper end of said handlebars to be oriented in a plurality of positions.

* * * * *